United States Patent [19]

Weith

[11] 3,996,129

[45] Dec. 7, 1976

[54] REACTION PRODUCT EFFLUENT SEPARATION PROCESS

[75] Inventor: James D. Weith, Pierrefonds, Canada

[73] Assignee: Universal Oil Products Company, Des Plaines, Ill.

[22] Filed: May 12, 1975

[21] Appl. No.: 576,779

[52] U.S. Cl. ..... 208/102; 208/104; 208/105; 208/351

[51] Int. Cl.[2] ..... C10G 7/00; C10G 7/02

[58] Field of Search ..... 208/102, 104, 105, 351

[56] References Cited

UNITED STATES PATENTS

| | | | |
|---|---|---|---|
| 3,477,946 | 11/1969 | Borst | 208/344 |
| 3,520,800 | 7/1970 | Forbes | 208/101 |
| 3,574,089 | 4/1971 | Forbes | 208/101 |
| 3,753,892 | 8/1973 | Weith | 208/102 |
| 3,801,494 | 4/1974 | Moore et al. | 208/102 |

*Primary Examiner*—Herbert Levine
*Attorney, Agent, or Firm*—James R. Hoatson, Jr.; Robert W. Erickson; William H. Page, II

[57] ABSTRACT

A reaction product effluent, containing hydrogen, normally gaseous hydrocarbons and normally liquid hydrocarbons, is separated into desired component streams in a system which incorporates a low-pressure flash zone, a debutanizer and a deethanizer. The net overhead vaporous product from the deethanizer is introduced into the flash zone, the liquid phase from which serves as a portion of the feed to the debutanizer. Preferably, the net overhead vaporous product from the debutanizer is also introduced into the flash zone.

11 Claims, 1 Drawing Figure

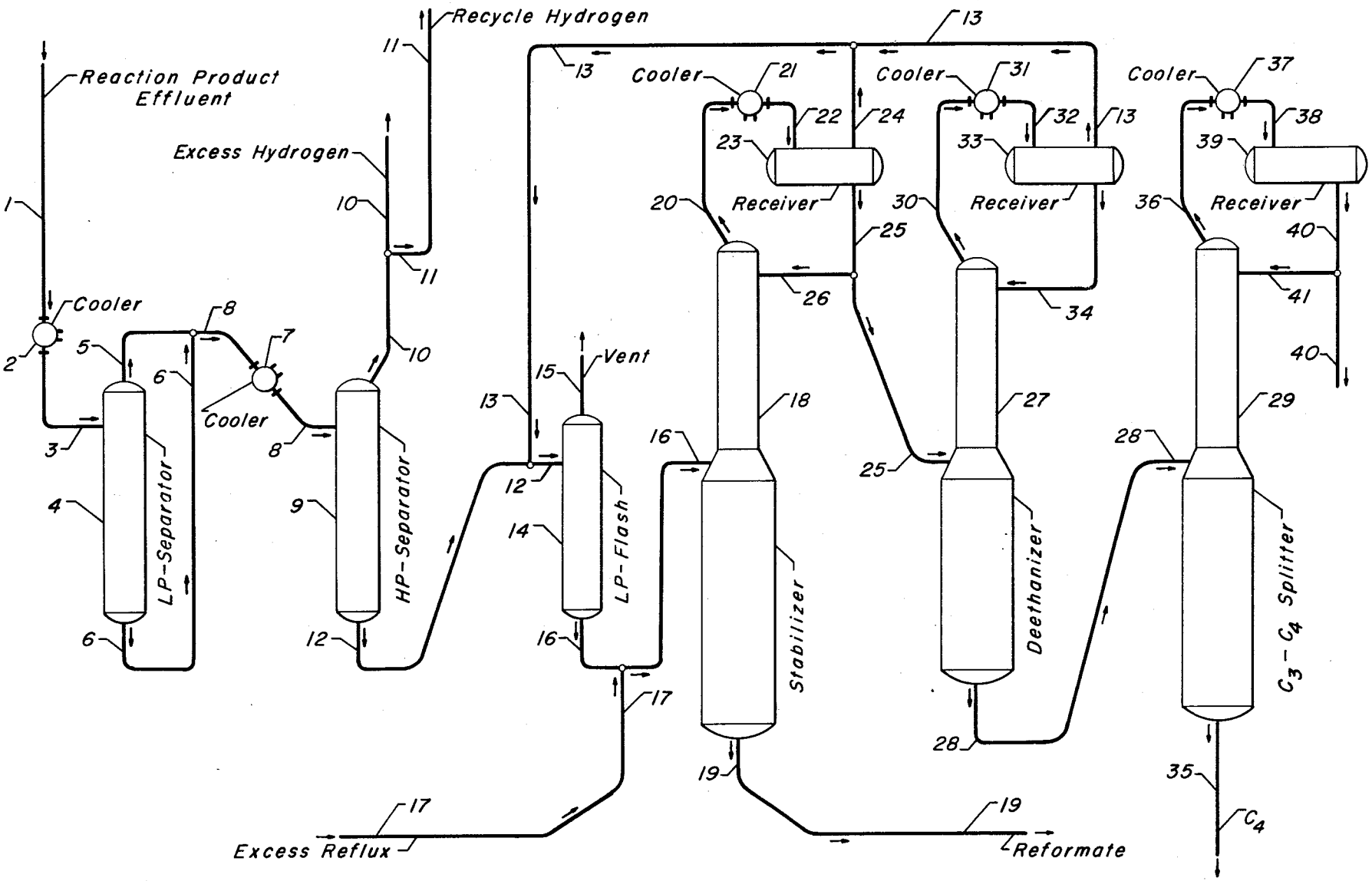
Reaction Product Effluent
Excess Hydrogen
Recycle Hydrogen
Cooler
LP-Separator
HP-Separator
LP-Flash
Vent
Stabilizer
Deethanizer
Receiver
$C_3 - C_4$ Splitter
$C_4$
Reformate
Excess Reflux

REACTION PRODUCT EFFLUENT SEPARATION PROCESS

APPLICABILITY OF INVENTION

The inventive concept herein described encompasses a process for effecting the separation of a reaction product effluent containing varying quantities of hydrogen, normally vaporous hydrocarbons and normally liquid hydrocarbons. More specifically, my invention is directed toward the separation of the product effluent emanating from a hydrocarbon conversion zone wherein the reactions are effected in a hydrogen atmosphere. The overwhelming proportion of hydrocarbon conversion processes utilize a dual-function catalytic composite generally disposed as a fixed-bed in one or more reaction zones. The dual-function characteristic stems from the fact that such catalysts are capable of effecting both dehydrogenation (non-acidic function) and hydrogenation (acidic function) reactions. They are, therefore, utilized to promote a wide variety of hydrocarbon conversion reactions including hydrocracking, isomerization, dehydrogenation, hydrogenation, desulfurization, ring-opening, catalytic reforming, cyclization, aromatization, alkylation, polymerization, cracking, etc., some of which reactions are categorized as hydrogen-producing, while others are hydrogen-consuming. One common attribute of the foregoing reactions resides in the fact that they are effected in a hydrogen-containing atmosphere. Furthermore, since the dual-function catalyst possesses at least an inherent degree of acidity, hydrocarbon conversion reactions generally result in the production of lower molecular weight, normally vaporous components such as methane, ethane, propane and butane. It is to this group of hydrocarbon conversion processes that the present invention is intended to be applicable. However, in the interest of brevity, the following discussion will be intentionally limited to the application of the present inventive concept to the well-known catalytic reforming process.

In the catalytic reforming process, four principal reactions are effected virtually simultaneously; the first is aromatization, in which naphthenic hydrocarbons are converted to aromatic hydrocarbons; the second is dehydrocyclization, in which aliphatic hydrocarbons of a straight-chain or slightly branched-chain configuration, are cyclicized and dehydrogenated to form aromatic hydrocarbons; the third reaction is isomerization, in which straight-chain or slightly branched-chain aliphatic hydrocarbons are converted to a more branched molecular configuration; the final principal reaction is hydrocracking, in which the larger paraffinic molecules are cracked to form smaller paraffinic molecules. The combined effect of these reactions produces a product effluent stream containing hydrogen, normally vaporous hydrocarbons and a high-octane, normally liquid fraction.

Similarly, a hydrocracking process, for example designed to convert a gas oil feedstock into naphtha boiling range hydrocarbons, is effected in a hydrogen atmosphere, and results in a reaction product effluent containing normally vaporous hydrocarbons (methane, ethane, propane and butane), hydrogen and normally liquid hydrocarbons (pentanes and heavier). A commonly practiced technique, whether in a hydrogen-consuming, or hydrogen-producing process, involves the recovery of a hydrogen-rich stream for re-use (recycle) within the process. This is required in order to maintain the necessary hydrogen partial pressure within the reaction zone for the purpose of prolonging the activity and stability of the catalytic composite disposed therein. In a hydrogen-producing process, excess hydrogen, over and above that required to maintain the hydrogen partial pressure, is usually utilized in other refinery processes which are hydrogen-consuming. Methane and ethane, which would otherwise act as contaminating influences, are removed to prevent a build-up thereof. Propane and butane, which possess valuable utility in and of themselves, are preferably recovered separately.

As hereinafter indicated, the separation process encompassed by the present inventive concept resembles the foregoing in that four component streams are recovered, or removed: a hydrogen-rich recycle stream, a methane/ethane concentrated vapor phase, a propane/-butane concentrated vapor phase and the normally liquid hydrocarbon product stream. However, there is afforded an increase in the quantity of methane/ethane removed, while simultaneously increasing the amount of propane/butane concentrate recovered, in addition to an advantage with respect to overall utilities.

OBJECTS AND EMBODIMENTS

A principal object of the present invention is to afford an improved process for effecting the separation of a reaction product effluent. A corollary objective resides in recovering increased quantities of a propane/butane concentrate.

A specific object of my invention is to provide a more efficient and economical reaction product effluent separation process.

Therefore, in one embodiment, the invention herein described is directed toward a process for separating a reaction product effluent containing (i) hydrogen, (ii) normally gaseous hydrocarbons and, (iii) normally liquid hydrocarbons, which process comprises the sequential steps of: (a) introducing said effluent into a first separation zone, at a lower temperature, to provide a hydrogen-rich first vaporous phase and a first liquid phase; (b) introducing said first liquid phase into a second separation zone, at substantially the same temperature and a reduced pressure, to provide a second liquid phase and to recover a $C_1/C_2$ concentrated second vaporous phase; (c) separating said second liquid phase, in a first fractionation zone, at fractionation conditions selected to provide (i) a $C_5$-plus concentrated normally liquid hydrocarbon stream and, (ii) a $C_4$-minus concentrated third vaporous phase; (d) condensing and separating said third vaporous phase to recover a $C_1/C_2$ concentrated fourth vaporous phase and to provide a first $C_3/C_4$ concentrated stream; (e) separating at least a portion of said first $C_3/C_4$ concentrated stream, in a second fractionation zone, at fractionation conditions selected to recover a second $C_3/C_4$ concentrated stream and to provide a $C_1/C_2$ concentrated fifth vaporous phase; and, (f) combining at least a portion of said $C_1/C_2$ concentrated fifth vaporous phase with said first liquid phase and introducing the resulting mixture into said second separation zone.

These, as well as other objects and additional embodiments, will become evident from the following description of the present process. In one such other embodiment, the methane/ethane concentrated fourth vaporous phase is also introduced into the second separation zone.

PRIOR ART

Briefly, the present invention makes use of a system which incorporates a low-pressure flash zone, a debutanizer (or stabilizer) and a deethanizer. The net overhead vaporous product from the deethanizer is introduced into the low-pressure flash zone, the liquid phase from which serves as part of the total feed to the debutanizer. Preferably, debutanizer net overhead vapors are also introduced into the low-pressure flash zone. It must necessarily be recognized and acknowledged that the appropriate prior art is replete with techniques for effecting reaction product effluent separation, and especially as directed toward recycle hydrogen enrichment and propane/butane (LPG) recovery. Any attempt herein to delineate exhaustively this particular area of hydrocarbon processing would be an exercise in futility. Warranted, however, Is a brief discussion and description of several processing scheme directed toward separation techniques for hydrogen enrichment and/or the recovery of a propane/butane concentrate. One of the earliest techniques, directed toward catalytic reforming, is that set forth in U.S. Pat. No. 3,296,118 (Cl. 208–100). A portion of the recovered normally liquid product, removed as a bottoms stream from the stabilizer (debutanizer), is recycled to the high-pressure, low-temperature separator into which the reaction product effluent is introduced. The process employs a single separation zone functioning at substantially the same pressure as the reaction zone and at a reduced temperature.

U.S. Pat. No. 3,477,946 (Cl. 208–344) constitutes an absorption process integrating a debutanizer, absorber and a deethanizer. Off gases from the deethanizer and debutanizer are countercurrently contacted in the absorber with a portion of the debutanized normally liquid product serving as the so-called lean absorber oil. The rich absorber oil, containing absorbed vaporous material, is introduced into the debutanizer in admixture with the unstabilized effluent from the reaction zone.

U.S. Pat. No. 3,516,924 (Cl. 208–65), eliminates the deethanizer and incorporates a low-pressure, high-pressure separation system into which the reaction product effluent is introduced. The rich absorber oil, containing absorbed vaporous material is recycled and introduced into the second, or high-pressure separation zone, the liquid phase from which serves as the feed to the stabilizer. A similar scheme is disclosEd in U.S. Pat. No. 3,520,799 (Cl. 208–101) which also utilizes stabilizer bottoms material as a lean absorber oil. Here, however, the low-pressure, high-pressure separation system, into which the reaction product effluent is passed, functions in a different manner. The vaporous phase from the initial low-pressure separation zone is compressed, and the liquid phase pumped, to an elevated pressure in the high-pressure separation zone, from which hydrogen is recycled to the reaction zone. This same technique, absent the absorber column, is found in U.S. Pat. No. 3,520,800 (Cl. 208–101).

Other separation techniques and processing schemes are illustrated by U.S. Pat. Nos. 3,537,978 (Cl. 208–101), 3,706,655 (Cl. 208–82) and 3,706,656 (Cl. 208–82). In U.S. Pat. No. 3,574,089 (Cl. 208–101), the reaction product effluent is introduced into a high-pressure, low-pressure separation system, with hydrogen being recycled from the high-pressure separator. The vaporous phase from the low-pressure separator is introduced into an absorber, while the liquid phase is introduced into a stripping column. The vapor phase from the latter is returned to the low-pressure separator in admixture with rich absorber oil. The liquid phase from the stripper constitutes the feed to the debutanizer, a portion of the liquid bottoms from which becomes the lean absorber oil. Vapors vented from the system (or fuel gas) are withdrawn as overhead from the absorber column.

Lastly, U.S. Pat. No. 3,753,892 (Cl. 208–102) incorporates the low-pressure, high-pressure separation system with a stabilizer which separates the liquid phase from the high-pressure separator. The vapor phase from the stabilizer is returned to the low-pressure separator.

A review of the foregoing indicates that there is no recognition of the separation process encompassed by the present invention. It will be readily ascertained that the present process does not have integrated therein an absorber, and further that the precise configuration of separation zones and fractionation zones is not found within the appropriate art.

SUMMARY OF INVENTION

As hereinbefore stated, the present separation process involves the integration of a high-pressure separation zone, a low-pressure flash zone, a stabilizer (or debutanizer) and a deethanizer. In one embodiment, the technique of U.S. Pat. Nos. 3,520,799 and 3,520,800 is utilized; that is, an additional separation zone receives the reaction zone effluent at substantially the same pressure, allowing only for pressure drop experienced as a result of fluid flow, and at a lower temperature. The separated vaporous phase and liquid phase are increased in pressure, recombined and introduced into the second separation zone. Basically, this constitutes the previously described low-pressure/high-pressure separation system of the prior art, and is, in essence, referred to as the hydrogen enrichment section. Principal benefits which accrue are a decrease in required utility costs and about a 2.0% to 5.0% increase in hydrogen concentration of the vaporous phase recycled from the high-pressure separator to the reaction zone. Particular advantages are experienced during the final stages of a process when the catalyst has become deactivated to the extent that hydrogen concentration begins to decrease. While the use of these first two separation zones forms no essential part of my invention, but rather is a technique upon which I improve, its use is preferred.

The present separation process is intended for utilization in both hydrogen-consuming and hydrogen-producing processes; that is, hydrocarbon conversion processes in which the reactions are effected in a hydrogen atmosphere. Regardless of the category in which the particular process is characterized, hydrogen is recovered and recycled to the reaction system. In a hydrogen-consuming process, make-up hydrogen is introduced from an external source, while in a hydrogen-producing process, excess hydrogen is removed for utilization elsewhere. Since specific examples of both types of processes have hereinbefore been set forth, and in the interest of brevity, the following discussion will be specifically directed toward the catalytic reforming process without the intent to so limit the invention, the scope and spirit of which is encompassed by the appended claims.

Catalytic reforming reactions, heretofore delineated, are effected at imposed pressures ranging from 50 psig. to about 1,000 psig. Recent developments in the reforming technology have, however, resulted in the ability to function at lower pressures — i.e. up to about 350 psig. — at which lower pressures the present invention is most advantageous. Catalyst bed temperatures are in the range of about 700° F. to about 1,100° F., although an upper limit of about 1,050° F. is adhered to in order to avoid harmful effects to the catalytic composite. Since reforming reactions are overall endothermic, the reaction product effluent temperature will be less than that at the inlet to the catalyst bed. Other operating conditions include a liquid hourly space velocity — volumes of charge stock per volume of catalyst — in the range of about 0.2 to about 10.0 and a hydrogen to hydrocarbon mole ratio of about 1.0:1.0 to about 10.0:1.0. With respect to the hydrogen concentration of the recycle gas stream, cautious operating techniques generally dictate a minimum of about 50.0%, by volume. Since this stream is recycled via compressive means, wherein weight becomes a primary factor, higher hydrogen concentrations of the order of about 70.0%, by volume, result in significant savings in utilities. Concentrations above about 80.0% are usually unwarranted since there appears to be no additional benefit with respect to the catalytic composite.

In accordance with the present invention, the reaction product effluent is cooled and condensed to a temperature in the range of about 60° F. to about 140° F. and introduced into a separation zone either at substantially the same pressure, or at some elevated pressure. As utilized herein, the use of the phrase "substantially the same pressure" is intended to allude to the fact that there is no intentional increase, or decrease in pressure, excepting, of course, the loss in pressure as a result of fluid flow through the system. This is also the case where the phrase "substantially the same temperature" is used. There is provided a hydrogen-rich (about 77.7% hydrogen) gaseous phase, a portion of which is recycled to the reaction zone, a second portion being withdrawn from the process as excess hydrogen for use elsewhere in the refinery complex. The liquid phase from this high-pressure separator constitutes the charge to the gas concentration section of the product separation process. In the previously described preferred technique, the cooled product effluent is initially introduced into a low-pressure separator, the vaporous and liquid phases from which are increased in pressure, combined and introduced into the high-pressure separator.

The high-pressure separator liquid phase is introduced into a low-pressure flash zone, at substantially the same temperature, but at a significantly reduced pressure — e.g. at least about 75 psig. lower than the high-pressure separator pressure. By way of brief summation, it will be presumed that the separation system is utilized in a low-pressure catalytic reforming process being operated at a pressure in the range of 100 psig. to about 400 psig., and comprising three individual reaction zones having suitable heat-exchange facilities therebetween. The initial low-pressure separation zone will function at substantially the same pressure as the effluent emanating from the last reaction zone, the high-pressure separator at a level of at least about 50 psig. higher than the reaction product effluent and the low-pressure flash zone at least 75 psig. lower than the high-pressure separator. In the specific example hereinafter set forth in conjunction with the description of the accompanying drawing, the reactant stream is introduced into the first of three reactors at a pressure of about 330 psig., and emanates from the third reaction zone at a pressure of about 295 psig. At first glance, this appears to be a relatively severe pressure drop. However, it must be remembered that the reactant stream traverses the catalyst in three reaction zones and two interheaters there-between. Following its use as a heat-exchange medium, the reaction product effluent is cooled and condensed, and introduced into the low-pressure separator at a pressure of about 270 psig. Following compression of the separated liquid and vaporous phases, the effluent is introduced into the high-pressure separator at a pressure of about 370 psig., the liquid phase from which is introduced into the low-pressure flash zone at a pressure of about 230 psig. As a general proposition, in such a low-pressure catalytic reforming process, the low-pressure separation zone will be maintained at a pressure from about 100 psig. to about 300 psig., the high-pressure separator at a pressure in the range of about 150 psig. to about 400 psig. and the low-pressure flash zone at a pressure of about 75 psig. to about 325 psig. In all instances, the temperature of the material entering the separation zones will be in the range of about 60° F. to about 140° F.

Aside from the excess hydrogen-rich vaporous phase withdrawn from the high-pressure separator and utilized elsewhere in the refinery, the vaporous phase from the low-pressure flash zone constitutes the sole vent gas stream from the present separation process. This stream is concentrated in methane and ethane, comprising at least about 60.0% by volume thereof. Furthermore, this vent stream contains less than about 10.0% of the propane and butane available for recovery within the gas concentration section of the separation system. The liquid phase from the low-pressure flash zone is introduced into the stabilizer from which the normally liquid product is recovered as a bottoms stream. In the example which follows, this stream contains less than 1.0% by volume of butanes and lighter hydrocarbons. The vaporous phase from the stabilizer is cooled and condensed, a portion of the condensate liquid being utilized as reflux to the column, the remainder being introduced into a deethanizer, while the so-called stabilizer net off-gas, containing more than about 50.0% methane and ethane, is introduced into the low-pressure flash zone in admixture with the high-pressure separated liquid phase. In the present specification, as well as in the appended claims, the term "stabilizer" is intended to be synonymous with "debutanizer" to connote a fractionation zone wherein a principally liquid hydrocarbon stream is separated from normally gaseous hydrocarbons.

The deethanizer serves to provide a concentrated propane/butane concentrate substantially free from methane and ethane. Although not essential to the present invention, the bottoms stream from the deethanizer may be introduced into a $C_3$-$C_4$ splitter column in order to recover separately a propane concentrate as the overhead stream and a butane concentrate as the bottoms stream. The vaporous phase withdrawn as an overhead stream from the deethanizer is condensed and cooled to supply the necessary reflux to the column. The remaining portion is recycled to combine with the liquid phase from the high-pressure separator, for introduction therewith into the low-pressure flash zone. As just described, and hereinafter specifically indicated, the present separation process lends itself to the recovery of propane and butanes from external streams originating in various other processes. In a specific illustration, the recovery of propane and butanes is greater than about 95.0%.

In order to illustrate further the present separation process, and the benefits to be accrued through the utilization thereof, it will be presumed that only the off-gas from the debutanizer is introduced into the low-pressure flash drum in admixture with the high-pressure separator liquid stream. This constitutes one of the preferred embodiments of my invention. For the sole purpose of this discussion, and for the sake of simplicity, only the propane loss will be considered. The propane content of the high-pressure separator liquid stream approximates 65.88 moles/hour. Propane loss in the debutanizer, as a result of the necessity to provide reflux therein, is about 44.38 moles/hour, or 67.4%. With the debutanizer off-gas being introduced into the low-pressure flash drum, the propane loss drops to about 2.99 moles/hour, or about 4.4%. However, when taken in conjunction with the propane loss experienced in the deethanizer, as a result of "making" the needed quantity of reflux therein, the total loss becomes 17.99 moles/hour, or about 27.3%. When utilizing the lean oil absorber technique, exemplified by the prior art previously described, with both the net off-gas from the debutanizer and that from the deethanizer being introduced into the absorber, there is experienced only a slight improvement. With the absorber arrangement, the propane loss is 16.47 moles/hour, or about 25.0%. Additionally, there exists a significant increase in initial capital expenditure as well as an increase in process utility requirements due to the necessity of cooling the lean oil and restabilizing the rich oil. Through the incorporation of the present invention, the propane loss is at its lowest, 9.93 moles/hour, or about 15.1%. As hereinbefore stated, and as hereinafter illustrated in a specific example, the present process readily lends itself to recovering simultaneously propane and butane from other refinery processes; in this illustration, out of a total propane content, in the stream introduced into the low-pressure flash drum, of 195.38 moles/hour, the loss is only 16.21 moles/hour, or about 8.3%.

Other processing techniques and operating conditions will be given in conjunction with the description of the several embodiments of the present invention as illustrated in the accompanying drawing. Miscellaneous appurtenances, not believed required by those possessing the requisite expertise in the appropriate art, have been eliminated from the drawing. The use of such details as pumps, compressors, controls and instrumentation, heat-recovery circuits, valving, start-up lines and similar hardware, etc., is well within the purview of one skilled in the art. It is understood that the illustration does not limit my invention beyond the scope and spirit of the appended claims.

DESCRIPTION OF DRAWING

With reference now to the drawing, the present separation process will be described in conjunction with a commercially-designed catalytic reforming process having a hydrocarbon charge rate of about 12,000 Bbl./day. The intended object is to produce a normally liquid product effluent having a clear research octane rating of about 100.0, while simultaneously recovering a concentrated propane/butane stream. Briefly, the catalytic reforming unit consists of three fixed-bed reaction zones having interheaters there-between. The naphtha charge stock, in the amount of 1237.95 moles per hour, at a pressure of about 365 psig., is admixed with a hydrogen-rich (77.7%) recycle gas stream in the amount of 11,152.18 moles per hour at a pressure of 370 psig. Following heat-exchange with one or more hot effluent streams and a further increase in temperature through the use of a direct-fired heater, the combined charge enters the first reaction zone at a pressure of about 330 psig., and emanates from the third reaction zone at a pressure of about 295 psig. Following its use as a heat-exchange medium and further cooling, the reaction product effluent, having the composition indicated in the following Table I, is at a temperature of about 140° F. and a pressure of about 275 psig.

TABLE I

| Component | Reaction Product Effluent Moles/Hr. | Vol.% |
|---|---|---|
| Hydrogen | 9834.34 | 70.3 |
| Methane | 1389.55 | 10.0 |
| Ethane | 747.60 | 5.3 |
| Propane | 466.25 | 3.3 |
| Iso-butane | 117.87 | 0.8 |
| N-Butane | 151.46 | 1.1 |
| Iso-Pentane | 94.64 | 0.7 |
| N-Pentane | 57.69 | 0.4 |
| Hexane-Plus | 1138.92 | 8.1 |

The reaction product effluent is introduced, via line 1, into cooler 2 wherein the temperature is decreased to 100° F. and the pressure to 270 psig. The thus-cooled effluent is withdrawn by way of line 3 and introduced thereby into low-pressure separator 4. A principally vaporous phase is withdrawn by way of line 5 and introduced into a compressor not illustrated in the drawing, with the result that the temperature becomes 164° F. and the pressure 378 psig. A principally liquid phase is withdrawn by way of line 6 and, via pumping means, is admixed with the principally vaporous phase at a temperature of 100° F. and a pressure of 382 psig. The mixture continues through line 5 into cooler 7 wherein the temperature is lowered to 100° F. The thus-cooled material is withdrawn by way of line 8 and introduced into high-pressure separator 9 at a pressure of about 370 psig.

A principally vaporous phase is withdrawn from high-pressure separator 9 by way of line 10 and, following the diversion of the required recycled hydrogen through line 11, the excess hydrogen continues through line 10 to be utilized in other areas of the overall refinery. A principally liquid phase is withdrawn by way of line 12 and introduced thereby into low-pressure flash zone 14. Component analyses of the excess hydrogen in line 10, the recycle hydrogen in line 11 and the principally liquid phase in line 12 are presented in the following Table II:

TABLE II

| Component, Moles/Hr. | HP-Separator Stream Analyses Line 10* | Line 11 | Line 12 |
|---|---|---|---|
| Hydrogen | 1155.16 | 8665.66 | 13.52 |
| Methane | 161.66 | 1212.73 | 15.16 |
| Ethane | 83.83 | 628.83 | 34.94 |
| Propane | 47.09 | 353.28 | 65.88 |
| Iso-Butane | 10.14 | 76.07 | 31.66 |
| N-Butane | 11.83 | 88.76 | 50.87 |
| Iso-Pentane | 5.17 | 38.74 | 50.73 |
| N-Pentane | 2.72 | 20.43 | 34.54 |

TABLE II-continued

| Component, Moles/Hr. | HP-Separator Stream Analyses Line 10* | Line 11 | Line 12 |
|---|---|---|---|
| Hexane-Plus | 9.03 | 67.68 | 1062.21 |

*Excess Hydrogen Only

With respect to the excess hydrogen being withdrawn by way of line 10, the 69.06 moles per hour of propane/butane (4.65%) may be returned to the present separation process after utilization of this excess hydrogen stream in another processing unit. The liquid phase in line 12 constitutes a portion of the feed to low-pressure separator 14, the remainder being the mixture of net off-gas from the stabilizer and the deethanizer (line 13). The mixture is introduced into low-pressure flash drum 14 at a temperature of 120° F. and a pressure of about 225 psig. The vaporous phase removed via line 15 is concentrated in methane and ethane, and contains 20.06 moles/hour, of propane and butanes. The amount of propane, 16.21 moles/hour, is greater than the 9.93 moles/hour previously stated in view of the fact that the latter resulted from a consideration only of the high-pressure liquid phase in line 12, and not the excess reflux introduced by way of line 17 as hereinafter described. Component analyses of the vapor and liquid streams, lines 15 and 16, from low-pressure flash zone 14 are presented in the following Table III:

TABLE III

| Component | Flash Zone Stream Analyses Line 15 Moles/Hr. | Line 15 Vol.% | Line 16 Moles/Hr. | Line 16 Vol.% |
|---|---|---|---|---|
| Hydrogen | 13.52 | 10.8 | 1.92 | 0.1 |
| Methane | 17.91 | 14.3 | 18.40 | 1.1 |
| Ethane | 70.82 | 56.7 | 296.75 | 16.8 |
| Propane | 16.21 | 12.9 | 193.06 | 11.0 |
| Iso-Butane | 1.70 | 1.4 | 40.14 | 2.3 |
| N-Butane | 2.15 | 1.7 | 67.34 | 3.8 |
| Iso-Pentane | 0.70 | 0.6 | 50.16 | 2.8 |
| N-Pentane | 0.38 | 0.3 | 34.33 | 1.9 |
| Hexane-Plus | 1.61 | 1.3 | 1060.60 | 60.2 |

The low-pressuRe flash liquid stream in line 16 is admixed with an externally-derived excess reflux stream in line 17. The source of this stream are stabilizing columns integrated into a crude fractionation system and a thermal reforming unit. Of the 444.75 moles/hour of excess reflux, 88.5% constitute propane and butanes. The mixture continues through line 16, and is introduced thereby into stabilizer 18 at a temperature of about 226° F. and a pressure of about 277 psig. Stabilizer 18, in the present illustration, functions at a bottoms temperature of about 481° F. and a pressure of about 260 psig., and a top temperature of about 158° F. and a pressure of about 255 psig. The overhead vaporous stream is withdrawn through line 20 and introduced into cooler 21, wherein the temperature is decreased to about 100° F. Normally liquid reformed product is removed through line 19 in the amount of 1157.21 moles/hour, and contains only about 0.5% butanes. These are not considered "lost" butanes since they are recovered in the liquid product stream which will have its vapor pressure, or volatility, subsequently adjusted for motor fuel purposes through the addition of butanes. A component analysis of the reformed product stream is presented in the following Table IV:

TABLE IV

| Component | Reformed Product Component Analysis Moles/Hour | Vol.% |
|---|---|---|
| Iso-Butane | 2.30 | 0.2 |
| N-Butane | 3.46 | 0.3 |
| Iso-Pentane | 55.82 | 4.8 |
| N-Pentane | 35.03 | 3.0 |
| Hexanes-Plus | 1060.60 | 91.7 |

The cooled overhead vapors from stabilizer 18 are introduced into overhead receiver 23 by way of line 22. Uncondensed vapors are withdrawn through line 24 and recycled via line 13 to combine with the high-pressure separator liquid in line 12. The condensed liquid is removed via line 25, and a portion thereof is diverted through line 26 as required reflux to stabilizer 18. The remainder continues through line 25, in the amount of 839.73 moles/hour, and is introduced into deethanizer 27 at a temperature of about 173° F. and a pressure of about 275 psig. Component analyses of the net off-gas in line 24 and the net liquid in line 25 are presented in the following Table V:

TABLE V

| Component | Stabilizer Overhead Component Analyses Line 24 Moles/Hr. | Line 24 Vol.% | Line 25 Moles/Hr. | Line 25 Vol.% |
|---|---|---|---|---|
| Hydrogen | 1.76 | 0.8 | 0.16 | — |
| Methane | 14.12 | 6.7 | 7.03 | 0.8 |
| Ethane | 111.52 | 53.0 | 221.11 | 26.3 |
| Propane | 54.01 | 25.7 | 268.55 | 32.1 |
| Iso-Butane | 10.18 | 4.8 | 98.23 | 11.7 |
| N-Butane | 18.62 | 8.8 | 238.90 | 28.4 |
| Iso-Pentane | 0.13 | 0.1 | 3.43 | 0.4 |
| N-Pentane | 0.07 | 0.1 | 2.32 | 0.3 |

From the foregoing Table, it will be noted that the net off-gas from stabilizer 18 is about 59.7% methane/ethane and that the net liquid bottoms, serving as the feed to deethanizer 27, consists of about 72.2% propane/butane.

The net liquid stream in line 25 is introduced into deethanizer 27 at a temperature of about 163° F., and a pressure of about 470 psig. The deethanizer functions at a bottoms temperature of about 242° F. and a pressure of about 460 psig., and a top temperature of about 117° F. and a pressure of about 455 psig. An overhead stream is removed via line 30, introduced into cooler 31, wherein the temperature is lowered to about 100° F., and, via line 32 into overhead receiver 33. The condensed material is removed via line 34 to be used as deethanizer reflux, and the vaporous phase is withdrawn through line 13, wherein it is admixed with the stabilizer net off-gas in line 24, the mixture continuing through line 13 to be admixed with the high-pressure liquid in line 12 as aforesaid. Component analyses of the deethanizer off-gas and the bottoms stream are presented in the following Table VI:

TABLE VI

| Component | Deethanizer Stream Analyses Line 13 Moles/Hr. | Line 13 Vol.% | Line 28 Moles/Hr. | Line 28 Vol.% |
|---|---|---|---|---|
| Hydrogen | 0.16 | — | — | — |
| Methane | 7.03 | 2.2 | — | — |
| Ethane | 221.11 | 69.6 | — | — |
| Propane | 89.38 | 28.2 | 179.17 | 34.3 |
| Iso-Butane | — | — | 98.23 | 18.9 |
| N-Butane | — | — | 238.90 | 45.8 |
| Iso-Pentane | — | — | 3.43 | 0.6 |

TABLE VI-continued

| | Deethanizer Stream Analyses | | | |
|---|---|---|---|---|
| | Line 13 | | Line 28 | |
| Component | Moles/Hr. | Vol.% | Moles/Hr. | Vol.% |
| N-Pentane | — | — | 2.32 | 0.4 |

From the foregoing, it is noted that the deethanizer bottoms stream contains propane and butanes in an amount of about 99.0%, and the off-gas predominates in methane and ethane, being about 71.8%.

In this particular unit, it is desired to recover the butanes and the propane as separate streams; therefore, the deethanizer bottoms liquid in line 28 is introduced thereby into $C_3$-$C_4$ splitter 29 at a pressure of about 275 psig. and a temperature of about 173° F. The splitter functions at a bottoms temperature of about 222° F. and a pressure of about 260 psig., and a top temperature of about 128° F. and a pressure of about 250 psig. The butane concentrate, 96.1%, is withdrawn through line 35. A propane concentrate is withdrawn through line 36, introduced into cooler 37, and passed through line 38 into overhead receiver 39 at a temperature of about 100° F. Reflux is returned to the column by way of line 41, and 171.27 moles/hour of propane recovered in line 40.

The foregoing clearly illustrates the manner in which the present separation process is effected and the advantageous benefits to be afforded through the utilization thereof. When separating the reaction product effluent in the fashion described, in the absence of any $C_3$-$C_4$ streams from a source external to the process, 84.93% of the propane and 96.46% of the butanes are recovered; on a combined basis, of the total propane/-butane being introduced into the gas concentration section via the high-pressure separator liquid phase, 91.34% is recovered. When an external stream is introduced into the separation, as in the foregoing illustration, propane recovery is 91.70%, the butane recovery is 98.89% and the overall recovery of the combined propane/butane is 96.30%.

I claim as my invention:

1. A process for separating a hydrocarbon conversion reaction product effluent containing (i) hydrogen, (ii) normally gaseous hydrocarbons and, (iii) normally liquid hydrocarbons, which process comprises the sequential steps of:

a. introducing said effluent into a first separation zone, at a lower temperature, to provide a hydrogenrich first vaporous phase and a first liquid phase;

b. introducing said first liquid phase into a second separation zone, at substantially the same temperature and a reduced pressure, to provide a second liquid phase and to recover a $C_1/C_2$ concentrated second vaporous phase;

c. separating said second liquid phase, in a first fractionation zone, at fractionation conditions selected to provide (i) a $C_5$-plus concentrated normally liquid hydrocarbon stream and, (ii) a $C_4$-minus concentrated third vaporous phase;

d. condensing and separating said third vaporous phase to recover a $C_1/C_2$ concentrated fourth vaporous phase and to provide a first $C_3/C_4$ concentrated stream;

e. separating at least a portion of said first $C_3/C_4$ concentrated stream, in a second fractionation zone, at fractionation conditions selected to recover a second $C_3/C_4$ concentrated stream and to provide a $C_1/C_2$ concentrated fifth vaporous phase; and, f. combining at least a portion of said $C_1/C_2$ concentrated fifth vaporous phase with said first liquid phase and introducing the resulting mixture into said second separation zone.

2. The process of claim 1 further characterized in that said methane/ethane concentrated fourth vaporous phase is introduced into said second separation zone.

3. The process of claim 1 further characterized in that said first separation zone is maintained at a pressure at least about 50 psig. higher than said reaction product effluent.

4. The process of claim 1 further characterized in that said second separation zone is maintained at a pressure at least about 75 psig. lower than said first separation zone.

5. The process of claim 1 further characterized in that said reaction product effluent is separated at substantially the same pressure and at a lower temperature, in an initial separation zone, the vapor phase and liquid phase from which are increased in pressure, admixed and introduced into said first separation zone.

6. The process of claim 5 further characterized in that said initial separation zone is maintained at a temperature in the range of about 60° F. to about 140° F. and a pressure from about 100 psig. to about 300 psig.

7. The process of claim 1 further characterized in that said first separation zone is maintained at a temperature of about 60° F. to about 140° F. and a pressure in the range of about 150 psig. to about 400 psig.

8. The process of claim 1 further characterized in that said second separation zone is maintained at a temperature of about 60° F. to about 140° F. and a pressure of about 75 psig. to about 325 psig.

9. The process of claim 1 further characterized in that the methane/ethane concentration in said fourth vaporous phase is at least about 50.0%, and that the $C_3/C_4$ concentration in said first stream is at least about 65.0%.

10. The process of claim 1 further characterized in that the concentration of $C_1/C_2$ in said fifth vaporous phase is at least about 65.0% and that the concentration of $C_3/C_4$ in said second stream is at least about 95.0%.

11. The process of claim 1 further characterized in that said reaction product effluent emanates from a catalytic reforming reaction zone.

* * * * *